US011211221B2

(12) United States Patent
Yokomizo et al.

(10) Patent No.: US 11,211,221 B2
(45) Date of Patent: Dec. 28, 2021

(54) CHIP-TYPE FUSE

(71) Applicant: Murata Manufacturing Co., Ltd., Kyoto-fu (JP)

(72) Inventors: Eiji Yokomizo, Nagaokakyo (JP); Masatoshi Kariya, Nagaokakyo (JP); Masashi Matsubara, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/833,331

(22) Filed: Mar. 27, 2020

(65) Prior Publication Data

US 2020/0227225 A1 Jul. 16, 2020

Related U.S. Application Data

(63) Continuation of application No. PCT/JP2018/035665, filed on Sep. 26, 2018.

(30) Foreign Application Priority Data

Sep. 29, 2017 (JP) ..... JP2017-191485

(51) Int. Cl.
*H01H 85/175* (2006.01)
*H01H 85/48* (2006.01)
(Continued)

(52) U.S. Cl.
CPC ..... *H01H 85/48* (2013.01); *H01H 85/08* (2013.01); *H01H 85/143* (2013.01); *H01H 85/175* (2013.01)

(58) Field of Classification Search
CPC ..... H01H 69/02; H01H 85/08; H01H 85/143; H01H 85/165; H01H 85/17; H01H 85/175; H01H 85/1755; H01H 85/48
See application file for complete search history.

(56) References Cited

U.S. PATENT DOCUMENTS 4,918,420 A * 4/1990 Sexton ..... H01H 69/02 337/205
5,097,247 A * 3/1992 Doerrwaechter .... H01H 85/046 29/623

(Continued)

FOREIGN PATENT DOCUMENTS

CN 104347331 A 2/2015
JP 101-287905 A 11/1989

(Continued)

OTHER PUBLICATIONS

EPO machine translation of Fukuda JP 2014175146 A (Year: 2014).*

(Continued)

*Primary Examiner* — Jacob R Crum
(74) *Attorney, Agent, or Firm* — Studebaker & Brackett PC

(57) ABSTRACT

A chip-type fuse includes a main body portion composed of an insulating material, a fuse conductor that is disposed inside the main body portion and that has both end portions exposed at the main body portion, and a pair of outer electrodes that cover respective end portions of the main body portion and that are connected to respective end portions of the fuse conductor. A hollow portion is present inside the main body portion, and the fuse conductor has a fusing portion disposed along the wall surface of the hollow portion.

20 Claims, 9 Drawing Sheets

(51) Int. Cl.
*H01H 85/08* (2006.01)
*H01H 85/143* (2006.01)

(56) References Cited

U.S. PATENT DOCUMENTS 5,923,239 A * 7/1999 Krueger ..... H01H 69/022 337/297
6,384,708 B1 * 5/2002 Jollenbeck ..... H01H 85/0411 337/290
2005/0141164 A1 * 6/2005 Bender ..... H01H 85/0047 361/104
2007/0075822 A1 * 4/2007 Pachla ..... H01H 85/0411 337/297
2008/0191832 A1 * 8/2008 Tsai ..... H01H 85/046 337/297
2010/0245028 A1 * 9/2010 Washizaki ..... H01H 85/08 337/297
2010/0289612 A1 * 11/2010 Chiu ..... H01H 85/38 337/296
2013/0234822 A1 * 9/2013 Aurich ..... H01H 37/32 337/416
2013/0257579 A1 * 10/2013 Chiu ..... H01H 85/17 337/161
2015/0002258 A1 * 1/2015 Yoshida ..... H01H 85/38 337/273
2018/0025879 A1 * 1/2018 Ho ..... H01H 85/06 337/187

FOREIGN PATENT DOCUMENTS

JP H08-153456 A 6/1996
JP 2003-036779 A 2/2003
JP 2007-280919 A 10/2007
JP 2007-287504 A 11/2007
JP 2010-244773 A 10/2010
JP 2014-175146 A 9/2014
JP 2015-032424 A 2/2015

OTHER PUBLICATIONS

International Search Report issued in PCT/JP2018/035665; dated Nov. 20, 2018.
International Preliminary Report on Patentability and Written Opinion issued in PCT/JP2018/035665; dated Mar. 31, 2020.
An Office Action mailed by China National Intellectual Property Administration dated Jul. 26, 2021 which corresponds to Chinese U.S. Appl. No. 16/833,331.5 and is related to U.S. Appl. No. 16/833,331 with English language translation.

* cited by examiner

CHIP-TYPE FUSE

CROSS-REFERENCE TO RELATED APPLICATIONS

This application claims benefit of priority to International Patent Application No. PCT/JP2018/035665, filed Sep. 26, 2018, and to Japanese Patent Application No. 2017-191485, filed Sep. 29, 2017, the entire contents of each are incorporated herein by reference.

BACKGROUND

Technical Field

The present disclosure relates to a chip-type fuse.

Background Art

A chip-type fuse is a chip component (or rectangular surface mount device) having a fuse function. The chip-type fuse may include an insulating main body portion, a fuse conductor disposed on the surface of or inside the main body portion, and a pair of outer electrodes that cover respective end portions of the main body portion and that are connected to respective end portions of the fuse conductor.

To date, regarding a chip-type fuse in which a fuse conductor is disposed inside the main body portion, it is known that a space is formed in the main body portion and that the fusing portion of the fuse conductor is arranged in the space by suspending (floating) it to suppress heat dissipation from the fusing portion (heat-generating portion) of the fuse conductor to the main body portion for the purpose of improving the fusing characteristics, as described, for example, in Japanese Unexamined Patent Application Publication No. 2007-280919 and Japanese Unexamined Patent Application Publication No. 2007-287504.

Meanwhile, regarding an inductance element also having a fuse function in the related art, it is known that, in a co-sintering-type inductance element in which an inner conductor is disposed between layers in a multilayer body, a fusing portion is disposed integrally with the inner conductor and, in addition, a hollow portion is formed in the multilayer body around the fusing portion, as described, for example, in Japanese Unexamined Patent Application Publication No. 1-287905.

SUMMARY

In the above-described chip-type fuse in the related art, the main body portion is composed of an insulating resin bottom portion and a lid portion. The main body portion may be produced by preparing the bottom portion and the lid portion, each having a press-formed recessed portion in advance, arranging the fuse conductor so as to be suspended in the recessed portion of the bottom portion, superposing the lid portion on the bottom portion such that the recessed portion of the bottom portion and the recessed portion of the lid portion oppose each other so as to form a space portion, and performing bonding between these with an adhesive, as described, for example, in in Japanese Unexamined Patent Application Publication No. 2007-280919 and Japanese Unexamined Patent Application Publication No. 2007-287504. However, such a production method has limitations on the accuracy of forming the recessed portion into the insulating resin and on the accuracy of superposing the lid portion on the bottom portion. If such a chip-type fuse in the related art is made smaller merely in size, the distance between the outer electrode and the fusing portion is scaled down and decreased, heat dissipation may be facilitated (fusing is thereby suppressed from occurring), and fusing characteristics may be degraded.

In this regard, the above-described inductance element also having a fuse function in the related art may be produced by coating the substantially central upper surface of a green sheet (ferrite green sheet) with an organic paste in a rectangular shape, performing drying so as to form an inner conductor (conductive paste) by printing on the green sheet, to which the organic paste is attached, such that the fusing portion is located on the organic paste, coating the resulting green sheet with a new organic paste in a rectangular shape (so as to be superposed on the organic paste applied earlier), performing drying, stacking new green sheets appropriately on the top and the bottom of the green sheet on which the organic paste, the inner conductor having the fusing portion, and the organic paste are attached successively as described above, and performing co-sintering so as to burn and evaporate the organic paste on the top and the bottom of the fusing portion and to form a hollow portion around the fusing portion, as described, for example, in Japanese Unexamined Patent Application Publication No. 1-287905. However, regarding such a production method, since the inner conductor is printed on the green sheet, to which the organic paste is attached, by recoating so as to overcoat the organic paste, it is difficult to apply the inner conductor (in particular, a relatively narrow fusing portion) with high resolution, and bleeding during printing or variations during printing may occur. The same problems occur in the case in which an organic paste produced by mixing a fine powder of alumina, zirconia, or the like is used. Further, in such a production method, since the inner conductor (conductive paste) is sintered while the organic paste on the top and the bottom of the fusing portion is evaporated so as to cause the fusing portion of the inner conductor to float due to evaporation of the lower organic paste during sintering, it is difficult to form the fusing portion more finely.

Therefore, it is difficult for the chip-type fuse in the related art and the inductor element also having a fuse function in the related art to provide a smaller chip-type fuse having excellent fusing characteristics, and the latest demand for a reduction in chip size is not sufficiently addressed. Under the present circumstances, chip-type fuses with a 1005 size (1.0 mm×0.5 mm) or greater have been launched, but a chip-type fuse with a smaller size, for example, 0603 size (0.6 mm×0.3 mm), has not been launched.

Accordingly, the present disclosure provides a new chip-type fuse that has excellent fusing characteristics and that can be reduced in size.

According to the present disclosure, there is provided a chip-type fuse including a main body portion composed of an insulating material, a fuse conductor that is disposed inside the main body portion and that has both end portions exposed at the main body portion, and a pair of outer electrodes that cover respective end portions of the main body portion and that are connected to respective end portions of the fuse conductor. The main body portion has a hollow portion inside, and the fuse conductor has a fusing portion disposed along the wall surface of the hollow portion.

In the above-described chip-type fuse according to the present disclosure, since the fusing portion of the fuse conductor is disposed along the wall surface of the hollow portion, the fusing portion of the fuse conductor can be partly exposed to the hollow portion, and an unexposed portion can be supported by the main body portion. Since the fusing portion of the fuse conductor is exposed to the hollow portion, heat dissipation from the fusing portion of the fuse conductor to the main body portion can be suppressed. In addition, since the fusing portion of the fuse conductor is supported by the main body portion, the fusing portion can be finely and stably formed with high resolution. Therefore, according to the present disclosure, a new chip-type fuse that has excellent fusing characteristics and that can be reduced in size is provided.

According to an aspect of the present disclosure, the hollow portion may have two wall surfaces that are curved outward in opposite directions and that are opposite each other, and the fusing portion of the fuse conductor may be disposed along any one of the two wall surfaces.

According to an aspect of the present disclosure, the main body portion and the fuse conductor may constitute a sintered body.

According to an aspect of the present disclosure, the fusing portion may have a meandering shape.

According to an aspect of the present disclosure, a portion in contact with at least the fusing portion in the main body portion may be composed of a first insulating material having a thermal conductivity of 0.05 $W \cdot m^{-1} \cdot K^{-1}$ or more and 10.00 $W \cdot m^{-1} \cdot K^{-1}$ or less (i.e., from 0.05 $W \cdot m^{-1} \cdot K^{-1}$ to 10.00 $W \cdot m^{-1} \cdot K^{-1}$).

According to an aspect of the present disclosure, the main body portion may include a layer that is composed of the first insulating material having a thermal conductivity of 0.05 $W \cdot m^{-1} \cdot K^{-1}$ or more and 10.00 $W \cdot m^{-1} \cdot K^{-1}$ or less (i.e., from 0.05 $W \cdot m^{-1} \cdot K^{-1}$ or more and 10.00 $W \cdot m^{-1} \cdot K^{-1}$) and that has the fuse conductor and the hollow portion inside and may include at least one layer composed of a second insulating material having higher strength than the first insulating material. In such an aspect, the layer composed of the first insulating material may be disposed between two layers composed of the second insulating material.

According to an aspect of the present disclosure, the insulating material may be a non-magnetic material.

According to an aspect of the present disclosure, the chip-type fuse may have a length of 0.55 mm or more and 0.65 mm or less (i.e., from 0.55 mm to 0.65 mm) and a width of 0.25 mm or more and 0.35 mm or less (i.e., from 0.25 mm to 0.35 mm).

According to the present disclosure, a new chip-type fuse that has excellent fusing characteristics and that can be reduced in size is provided.

BRIEF DESCRIPTION OF THE DRAWINGS

FIGS. 13B to 13D are schematic diagrams of magnified portions corresponding to the fusing portions and the vicinities (for example, a region H surrounded by a dotted line in FIG. 13A) of the silver paste applied in examples 1 to 3, respectively.

DETAILED DESCRIPTION

A chip-type fuse according to an embodiment of the present disclosure and a manufacturing method thereof will be described below in detail with reference to the drawings, although the present disclosure is not limited to the embodiment.

Figure 1:
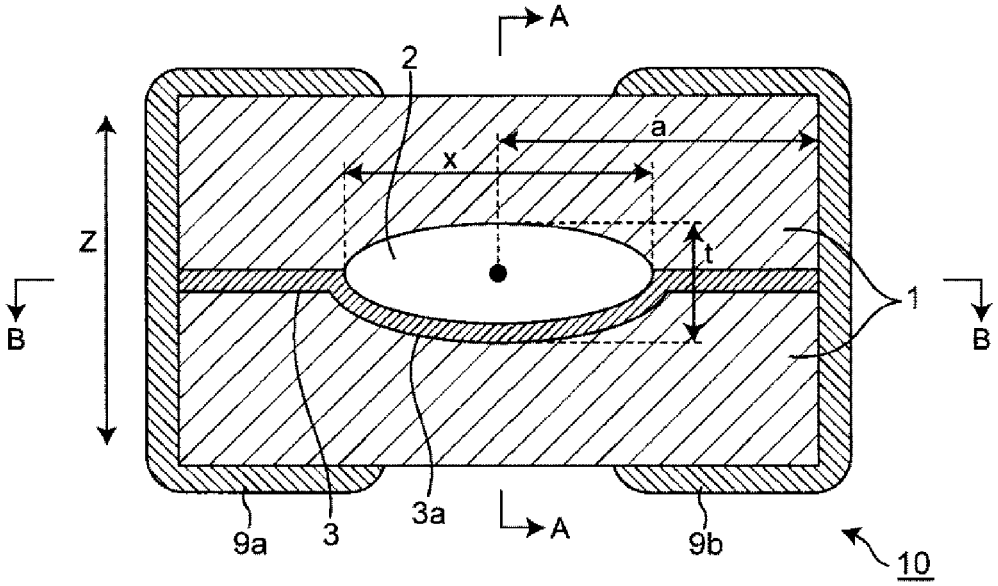
FIG. 1 is a schematic sectional view of a chip-type fuse according to an embodiment of the present disclosure.
Figure 2:
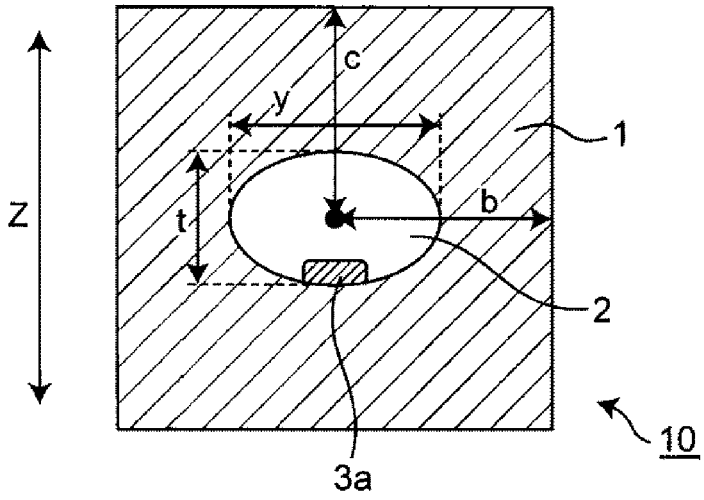
FIG. 2 is a schematic sectional view of the chip-type fuse cut along line A-A in FIG. 1.

As shown in FIG. 1, a chip-type fuse 10 according to the present embodiment includes a main body portion 1 composed of an insulating material, a fuse conductor 3 that is disposed inside the main body portion 1 and that has both end portions exposed at the main body portion 1, and a pair of outer electrodes 9*a* and 9*b* that cover respective end portions of the main body portion 1 and that are connected to respective end portions of the fuse conductor 3. As shown in FIGS. 1 and 2, there is a hollow portion 2 inside the main body portion 1, and the fuse conductor 3 has a fusing portion 3*a* disposed along the wall surface of the hollow portion 2. In other words, the hollow portion 2 is located immediately above the fusing portion 3*a* of the fuse conductor 3.

In the present disclosure, the term "fuse conductor" denotes a conductor (a member composed of an electrically conductive substance) for constituting a fuse and may also be referred to as an "inner conductor" because of being disposed inside the main body portion in the present disclosure. Meanwhile, the term "fusing portion" denotes a portion that is intended to generate heat and fuse when the chip-type fuse according to the present disclosure functions as a fuse and that may be a portion with a relatively narrow width in the fuse conductor.

According to the present embodiment, since the hollow portion 2 is located immediately above the fusing portion 3*a* of the fuse conductor 3, an unexposed portion of the fusing portion 3*a* can be brought into contact with the main body portion 1 (into close contact with the inner wall surface of the main body portion 1) so as to be supported by the main body portion 1 while the fusing portion 3*a* of the fuse conductor 3 is partly exposed to the hollow portion 3. Consequently, fusing characteristics with a narrow range of variations and with stability can be realized. In this regard, in the aspect described in the drawing, the upper surface and the side surface of the fusing portion 3*a* are exposed to the hollow portion 2, and the lower surface of the fusing portion 3*a* is supported by the main body portion 1. However, the present embodiment is not limited to this. The upper surface and part of the side surface of the fusing portion 3*a* may be exposed to the hollow portion 2, only the upper surface of the fusing portion 3*a* may be exposed to the hollow portion 2, or a mixed state of at least two of the above-described three states may be present in the track direction of the fusing portion 3*a*.

Since the fusing portion 3*a* of the fuse conductor 3 is exposed to the hollow portion 2, when a current passes through the fuse conductor 3, heat is suppressed from escaping due to conduction (heat dissipation) from the fusing portion 3*a* of the fuse conductor 3 to the main body portion 1 (and further to the outer electrode 9*a* and/or the outer electrode 9*b*) due to heat insulation effect of the hollow portion 2 (presence of air or other gases, for example, gases derived from a disappearing material, or application of a vacuum). Consequently, the heat is effectively confined to the fusing portion 3*a*, and fusion readily occurs. Therefore, there is no need to set the track length to be large (therefore, there is no need to set a long distance from the outer electrode to the fusing portion 3*a*). In addition, since the fusing portion 3*a* of the fuse conductor 3 is supported by the main body portion 1, as described later, a chip-type fuse can be produced by exploiting a printing method, and, consequently, the fusing portion 3*a* can be finely and stably formed with high resolution. As a result, even in the case of a smaller chip size, for example, 0603 size (0.6 mm×0.3 mm), excellent fusing characteristics can be obtained. For example, the central position of the hollow portion (indicated by a black point in each of FIGS. 1 and 2) may be located at a distance a of 250 μm or more and 350 μm or less (i.e., from 250 μm to 350 μm) from the outer wall surface of the main body portion 1 in the direction of the chip length L and may be located at a distance b or c (may be determined in accordance with the mounting direction) of 100 μm or more and 200 μm or less (i.e., from 100 μm to 200 μm) from the outer wall surface of the main body portion 1 in the direction of the chip width W. In this regard, the central position of the hollow portion is determined on the basis of the volume center.

In particular, in the chip-type fuse 10 according to the present embodiment, the hollow portion 2 has two wall surfaces that are curved outward in opposite directions and that are opposite each other, and the fusing portion 3*a* of the fuse conductor 3 is disposed along one of the two wall surfaces. Such two wall surfaces may have a clear boundary or no boundary and may be the upper wall surface and the lower wall surface in the aspect shown in the drawing, and the fusing portion 3*a* is disposed along the lower wall surface only. Consequently, the fusing portion 3*a* may be disposed so as to curve outward (downward in the aspect shown in the drawing). In the hollow portion 2, as the space dimension increases, a higher heat insulation effect and by extension a higher heat-dissipation suppressing effect are obtained. Therefore, preferably, the fusing portion 3*a* of the fuse conductor 3 is disposed in the substantially central region of one wall surface that is curved outward in the direction opposite to the other wall surface. Consequently, the fusing portion 3*a* can be selectively fused.

As shown in FIGS. 1 and 2, the hollow portion 2 may have a substantially elliptical cross-sectional shape, and the fusing portion 3*a* may be formed into a substantially arched shape. However, the present embodiment is not limited to such shapes. When the hollow portion 2 has an elliptical cross section with no corners, stress that may be applied to the main body portion 1 during the production process and/or during use thereafter can be effectively dispersed, and cracks or fractures that start from a corner (edge portion) can be suppressed or prevented from occurring in the main body portion 1.

In the present embodiment, the main body portion 1 and the fuse conductor 3 may constitute a sintered body that is co-sintered. In particular, a sintered body of a multilayer body may be adopted (in the drawings, the stacking direction is indicated by Z). In the present embodiment, the hollow portion 2 may be formed by evaporation of a disappearing material during firing.

There is no particular limitation regarding the dimensions and/or the volume (capacity) of the hollow portion 2. The height t of the hollow portion 2 is specified by the maximum distance from the surface on which the fusing portion 3*a* is present to the wall surface opposite the inner wall surfaces of the main body portion 1 (maximum distance between the inner wall surfaces of the main body portion 1 opposite each other in cross section in the stacking direction) and may be appropriately selected in accordance with the rated current value, the chip size, and the like. The height t may be, for example, 10 μm or more and 50 μm or less (i.e., from 10 μm to 50 μm). The length x of the hollow portion 2 is specified by the maximum dimension on the plane perpendicular to the direction of the height t and may be appropriately selected in accordance with the shape and the like of the fusing portion 3*a*. The length x may be, for example, 100 μm or more and 500 μm or less (i.e., from 100 μm to 500 μm). The width y of the hollow portion 2 is specified by the maximum dimension perpendicular to the direction of the height t and the direction of the length x and may be appropriately selected in accordance with the shape and the like of the fusing portion 3*a*. The width y may be, for example, 50 μm or more and 200 μm or less (i.e., from 50 μm to 200 μm). The volume of the hollow portion 2 may be $5\times10^4$ ($\mu m^3$) or more and $5\times10^6$ ($\mu m^3$) or less (i.e., from $5\times10^4$ ($\mu m^3$) to $5\times10^6$ ($\mu m^3$)).

It is preferable that the inner wall surface of the main body portion 1 exposed to the hollow portion 2 be smoother because heat is suppressed from escaping due to conduction from the fusing portion 3*a* of the fuse conductor 3 to the main body portion 1 through the hollow portion 2 and fusing readily occurs (if unevenness increases, the surface area is increased, the heat is readily conducted, and fusing does not readily occur). In the case in which the hollow portion 2 is formed by evaporation of a disappearing material during firing, the inner wall surface of the main body portion 1 exposed to the hollow portion 2 can be smoothed. The surface roughness Ra of the inner wall surface of the main body portion 1 may be, for example, 0.05 μm or more and 0.5 μm or less (i.e., from 0.05 μm to 0.5 μm) (in this regard, Ra is arithmetic mean roughness).

The chip-type fuse 10 may have at least one hollow portion 2, and at least one fusing portion 3*a* may be present in one hollow portion 2.

The fusing portion of the fuse conductor 3 is free to have various thicknesses and shapes in accordance with predetermined fusing characteristics and/or rated current. The thickness and the shape (in particular track width and track length) of the fusing portion of the fuse conductor are important because of having an influence on the fusing characteristics and the rated current.

Figure 3:
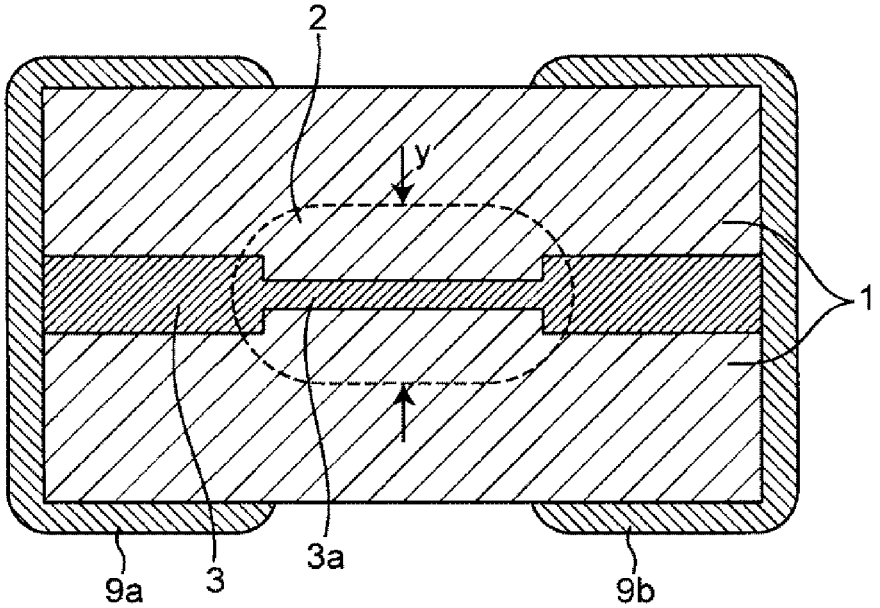
FIG. 3 is a schematic top view of the chip-type fuse virtually cut along line B-B in FIG. 1.
Figure 4:
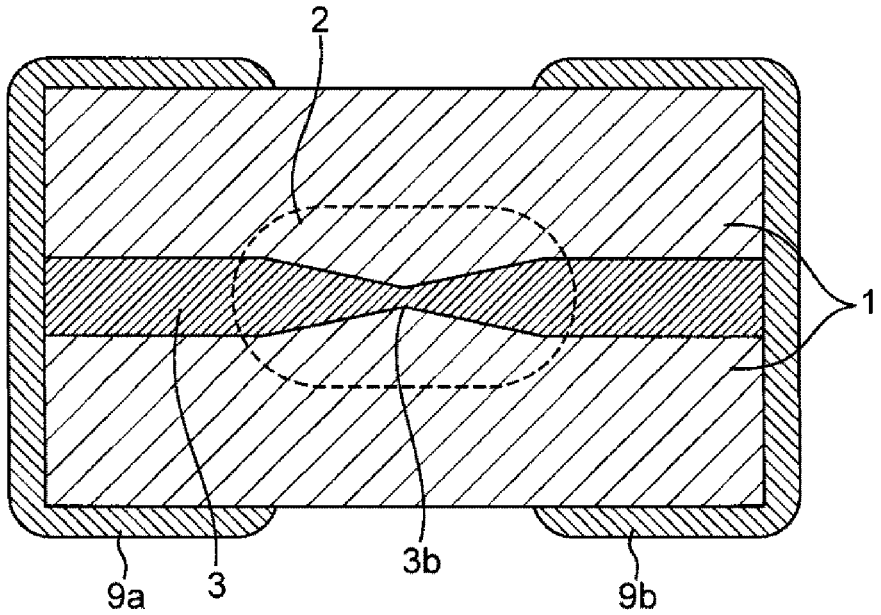
FIG. 4 is a drawing corresponding to FIG. 3 and showing a modified example of a fusing portion of a fuse conductor in the chip-type fuse.
Figure 5:
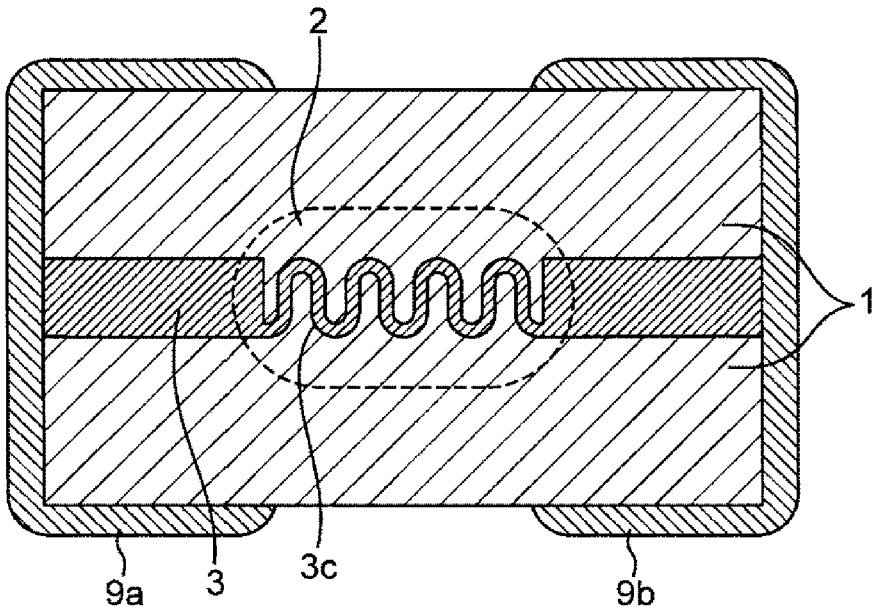
FIG. 5 is a drawing corresponding to FIG. 3 and showing another modified example of a fusing portion of the fuse conductor in the chip-type fuse.
Figure 6:
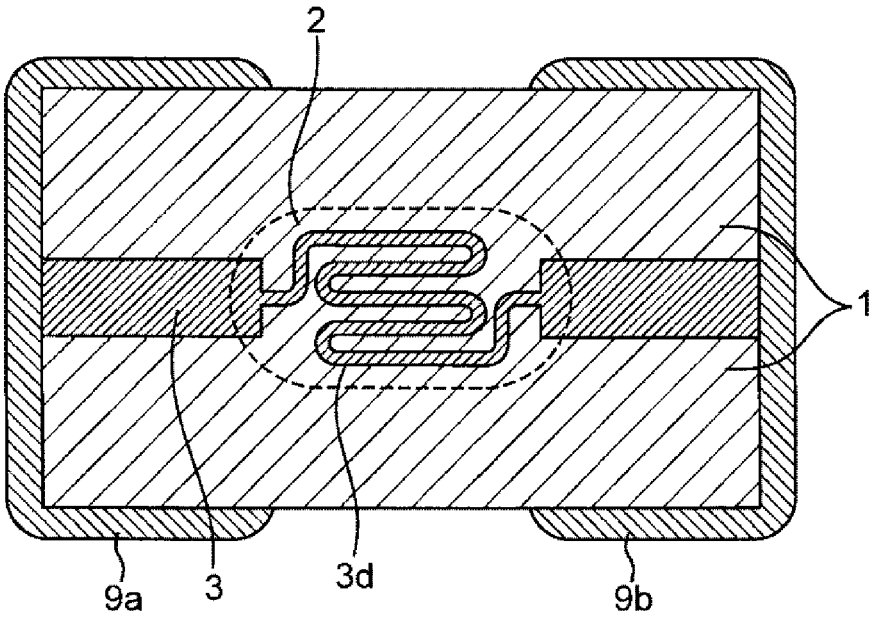
FIG. 6 is a drawing corresponding to FIG. 3 and showing another modified example of a fusing portion of the fuse conductor in the chip-type fuse.

To control the fusing characteristics, formation of the fusing portion of the fuse conductor into a predetermined shape is required. For example, as shown in FIG. 3, the fusing portion 3*a* may have a shape in which the track width is substantially constant and the track extends in the rectilinear direction (rectilinear type). However, the present embodiment is not limited to this. For example, as shown in FIG. 4, a fusing portion 3*b* having the shape in which the track extends in the rectilinear direction while the track width is gradually decreased and then increased (narrowed central portion type) may be applied. Alternatively, a fusing portion having a meandering shape may be adopted. In particular, for example, as shown in FIG. 5, a fusing portion 3*c* having a meandering shape in which the track width is substantially constant and the track extends in the length direction while the track is meandering may be applied. Alternatively, for example, as shown in FIG. 6, a fusing portion 3*d* having a meandering shape in which the track width is substantially constant and the track extends in the width direction while the track is meandering may be applied.

The dimensions of the fusing portions 3*a* to 3*d* may be appropriately selected in accordance with the current value applied for fusing. The thickness may be, for example, 1 μm or more and 10 μm or less (i.e., from 1 μm to 10 μm), the track width may be, for example, 10 μm or more and 50 μm or less (i.e., from 10 μm to 50 μm), and the track length may be, for example, 100 μm or more and 1,000 μm or less (i.e., from 100 μm to 1,000 μm) (each after firing).

The fuse conductor 3 is composed of any appropriate conductive material and may be formed of a metal, for example, silver, copper, nickel, tin, or aluminum, or an alloy of these. As described later, in the case in which the chip-type fuse is produced by exploiting a printing method, the fuse conductor 3 may be formed by using a conductive paste. There is no particular limitation regarding the conductive paste, and a silver paste, a copper paste, or the like may be used.

The main body portion 1 is composed of any appropriate insulating material and may be formed of, for example, a glass material, quartz, alumina, forsterite, or ferrite, or a mixture of at least two of these. As described later, in the case in which the chip-type fuse is produced by exploiting a printing method, the main body portion 1 may be formed by using an insulating material green sheet.

In the main body portion 1, a portion in contact with at least the fusing portion 3*a*, preferably a portion in contact with the fuse conductor 3 having the fusing portion 3*a* and the hollow portion 2, may be formed of a first insulating material having a thermal conductivity of 0.05 $W \cdot m^{-1} \cdot K^{-1}$ or more and 10.00 $W \cdot m^{-1} \cdot K^{-1}$ or less (i.e., from 0.05 $W \cdot m^{31}{}_{1} \cdot K^{-1}$ to 10.00 $W \cdot m^{-1} \cdot K^{-1}$). The first insulating material has a low thermal conductivity and can directly suppress the heat from escaping due to conduction (heat dissipation) from the fusing portion 3*a* of the fuse conductor 3 to the main body portion 1 (and further to the outer electrode 9*a* and/or the outer electrode 9*b*) when a current passes through the fuse conductor 3. Consequently, the heat can be effectively confined to the fusing portion 3*a* such that fusing occurs more readily, excellent fusing characteristics can be stably obtained, and chip size reduction can be further facilitated. In the present disclosure, the thermal conductivity of the insulating material may be specified in accordance with JIS R 1611 (Measurement methods of thermal diffusivity, specific heat capacity, and thermal conductivity for fine ceramics by flash method).

Examples of the first insulating material include a glass material (a filler may or may not be contained).

The entire main body portion 1 may be composed of the first insulating material. In this case, the main body portion 1 may be a sintered body of a multilayer body of a plurality of layers composed of the first insulating material.

However, preferably, the main body portion 1 includes a portion in contact with at least the fusing portion 3*a*, desirably a portion that is in contact with the fuse conductor 3 having the fusing portion 3*a* and the hollow portion 2 and that is composed of the first insulating material, and the other portion composed of the second insulating material having higher strength (mechanical strength, for example, flexural strength) than the first insulating material. In many cases, insulating materials having a low thermal conductivity such as glass materials have low strength (brittle). Conversely, in many cases, insulating materials having high strength have a high thermal conductivity. Therefore, compatibility between the suppression of heat dissipation and the strength can be ensured by forming the portion in contact with at least the fusing portion 3*a*, desirably a portion that is in contact with the fuse conductor 3 having the fusing portion 3*a* and the hollow portion 2, of the first insulating material having a high thermal conductivity and by forming the other portion, for example, at least one of the portions on the top, bottom, left, and right of the portion composed of the first insulating material, of the second insulating material having higher strength than the first insulating material. In the present disclosure, the strength of the insulating material may be specified in accordance with JIS R 1601 (Testing method for flexural strength (modulus of rapture) of fine ceramics at room temperature).

Examples of the second insulating material include alumina, forsterite, and ferrite. In the case in which a glass material is used as the first insulating material, it is preferable that ferrite be used as the second insulating material because co-firing with the glass material can be readily performed.

In the case in which the main body portion 1 is a sintered body of a multilayer body, the main body portion 1 may include a layer that is composed of the first insulating material and that has the fuse conductor and the hollow portion inside (low-thermal-conductivity layer) and at least one layer composed of a second insulating material having higher strength than the first insulating material (reinforcing layer). Extension of the layer composed of the second insulating material (reinforcing layer) in the direction of the length L of the chip-type fuse can particularly enhance the flexural strength.

Figure 7:
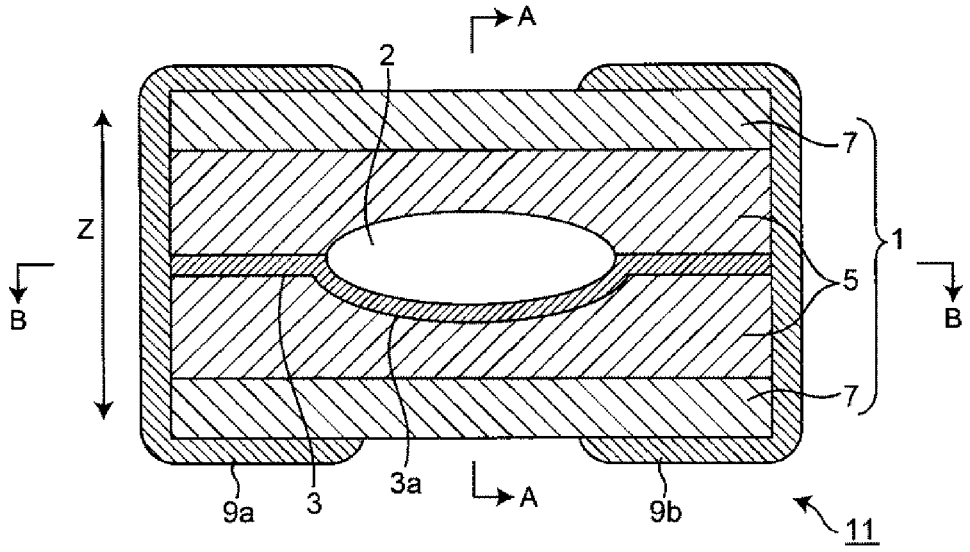
FIG. 7 is a schematic sectional view of an exemplary chip-type fuse according to the embodiment of the present disclosure shown in FIG. 1.
Figure 8:
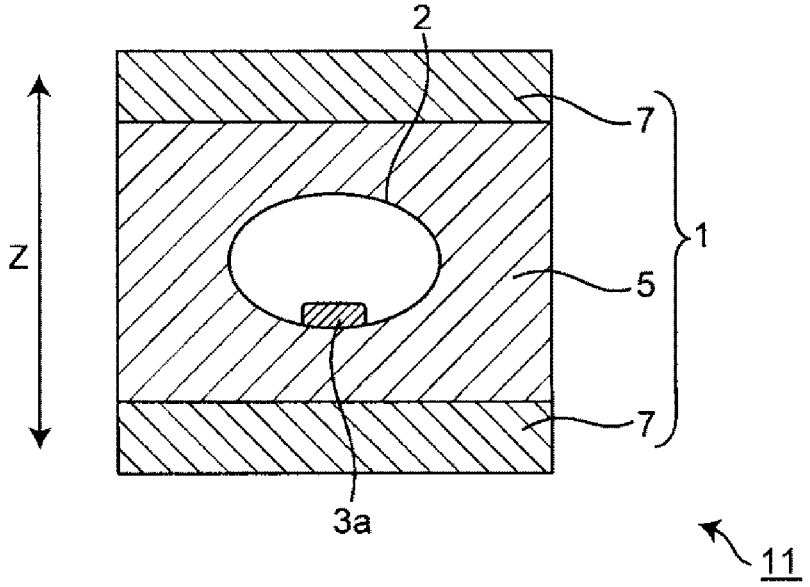
FIG. 8 is a schematic sectional view of the chip-type fuse cut along line A-A in FIG. 8.

For example, as shown in FIGS. 7 and 8, a layer 5 composed of the first insulating material (having the fuse conductor 3 and the hollow portion 2 inside) (low-thermal-conductivity layer) may be disposed between two layers 7 composed of the second insulating material (reinforcing layers). The thickness of the layer 5 composed of the first insulating material may be, for example, 50 μm or more and 200 μm or less (i.e., from 50 μm to 200 μm), and the thickness of the layer 7 composed of the second insulating material may be, for example, 50 μm or more and 125 μm or less (i.e., from 50 μm to 125 μm). However, the example shown in the drawing is not limited to being adopted, and the layer 7 composed of the second insulating material may be disposed on only one of the top and the bottom of the layer 5 composed of the first insulating material.

In the case in which the chip-type fuse is in no need of inductance, the chip-type fuse is suppressed from having impedance, or the like in accordance with the use of the chip-type fuse, the main body portion 1 may be composed of an insulating and non-magnetic material. In the case in which it is desirable to avoid flowing of current and/or signal to other components from being hindered or suppressed by impedance of a circuit due to mounting of the chip-type fuse in accordance with an electric-electronic circuit on which the chip-type fuse is mounted, such impedance can be minimized by using the non-magnetic material. Examples of the insulating and non-magnetic material include glass materials, quartz, alumina, forsterite, and non-magnetic ferrite. Examples of the non-magnetic first insulating material include glass materials (a filler may or may not be contained). Examples of the non-magnetic second insulating material include non-magnetic ferrite materials.

A glass material having any appropriate composition may be used as the glass material. A glass material containing, for example, 0.5% to 5% by weight of $K_2O$, 0% to 5% by weight of $Al_2O_3$, 10% to 25% by weight of $B_2O_3$, and 70% to 85% by weight of $SiO_2$ (where, the total is 100% by weight or less) is preferable. The glass material may be obtained by using a glass powder that is produced by weighing starting raw materials such as oxides and carbonates so as to ensure a predetermined glass composition, mixing these, placing the resulting mixture into a platinum crucible, performing melting at a temperature of 1,500° C. to 1,600° C., and performing rapid cooling and pulverization. Such a glass powder may be used without being processed, but a filler, for example, quartz or alumina, within the range of 10% to 50% by weight relative to the glass powder may be added to the glass powder so as to obtain the glass material.

A non-magnetic ferrite material having any appropriate composition may be used as the non-magnetic ferrite material. For example, a non-magnetic ferrite material containing 40% to 49.5% by mole of Fe in terms of $Fe_2O_3$, and containing 6% to 12% by mole of Cu in terms of CuO, the remainder being ZnO, is preferable. As the situation demands, the non-magnetic ferrite material may contain one of additives such as Mn, Sn, Co, Bi, and Si or at least two of these in any combination and/or may contain incidental impurities. The non-magnetic ferrite material may be produced by weighing raw materials at a predetermined ratio, adding additives as the situation demands, performing wet mixing-pulverization, performing drying, calcining the resulting dried material at a temperature of 700° C. to 800° C., and performing pulverization.

The outer electrodes 9*a* and 9*b* are composed of any appropriate conductive material and may be, for example, a metal conductor provided with at least one layer of plating.

Next, a method for manufacturing the chip-type fuse 10 according to the present embodiment will be described with reference to FIGS. 9A to 9E.

Figure 9A:
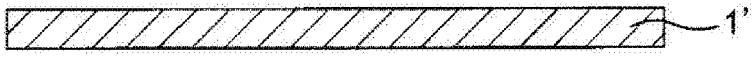
FIGS. 9A to 9E are diagrams illustrating a method for manufacturing the chip-type fuse according to the embodiment of the present disclosure shown in FIG. 1.

A green sheet 1' of the above-described insulating material (preferably, first insulating material) is prepared (FIG. 9A). The insulating material green sheet 1' may be obtained by mixing/kneading an insulating material powder with an organic vehicle containing a binder resin and an organic solvent and performing forming into the shape of a sheet, but the procedure is not limited to this.

Figure 9B:
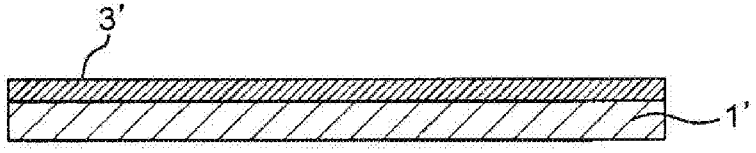

A conductor paste 3' having a predetermined pattern is applied to a smooth surface of the resulting insulating material green sheet 1' (FIG. 9B). Regarding the conductor paste, a commercially available common silver paste containing silver serving as a conductor in a powder state may be used, but the conductor paste is not limited to this. Screen printing may be favorably used as the printing method. The printing pattern is matched to the shape of the fuse conductor 3 (having the fusing portion 3*a*) to be formed finally.

Figure 9C:
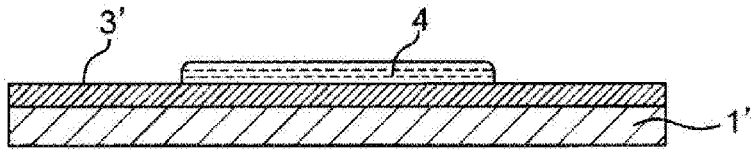

Subsequently, a disappearing material 4 is applied to the insulating material green sheet 1' to which the conductor paste 3' is applied (FIG. 9C). The disappearing material 4 is a material that can form the hollow portion 2 by evaporation during firing (not present in the finally obtained chip-type fuse due to evaporation and, therefore, "disappear") and may be a paste-like or liquid material. Regarding the disappearing material 4, a material that readily burns and evaporates due to thermal decomposition may be used. For example, an organic paste, in particular, a resin material such as an acrylic resin in a paste state, may be used. Regarding the printing method, screen printing may be favorably used. The region to which the disappearing material 4 is applied has to cover the portion corresponding to the fusing portion 3*a* in the conductor paste 3' applied in advance and is determined in accordance with the dimensions of the hollow portion 2 to be formed finally. In this regard, the disappearing material 4 may be applied to the insulating material green sheet 1', to which the conductor paste 3' is applied, by a method other than printing, for example, coating (for example, dispensing).

Figure 9D:
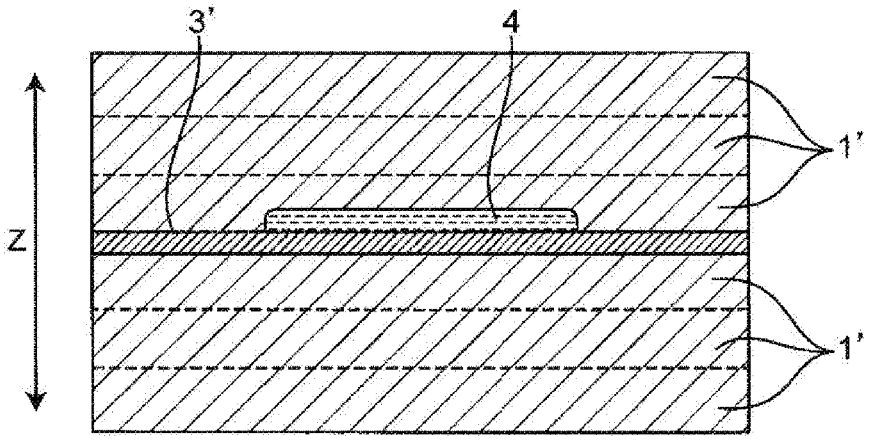

A multilayer body is obtained by stacking a predetermined number of new insulating material green sheets 1' on the top and the bottom of the insulating material green sheet 1' to which the conductor paste 3' and the disappearing material 4 are applied, obtained as described above, so as to ensure a predetermined thickness (in the drawing, the stacking direction is indicated by Z), performing pressure bonding, and performing cutting into predetermined dimensions (FIG. 9D). A plurality of multilayer bodies may be produced in the matrix in a single operation and cut with a dicing machine or the like into individual pieces (by element isolation) or may be produced individually in advance.

Regarding the method for forming the multilayer body, a sheet stacking method may be exploited, but the method is not limited to this.

Figure 9E:
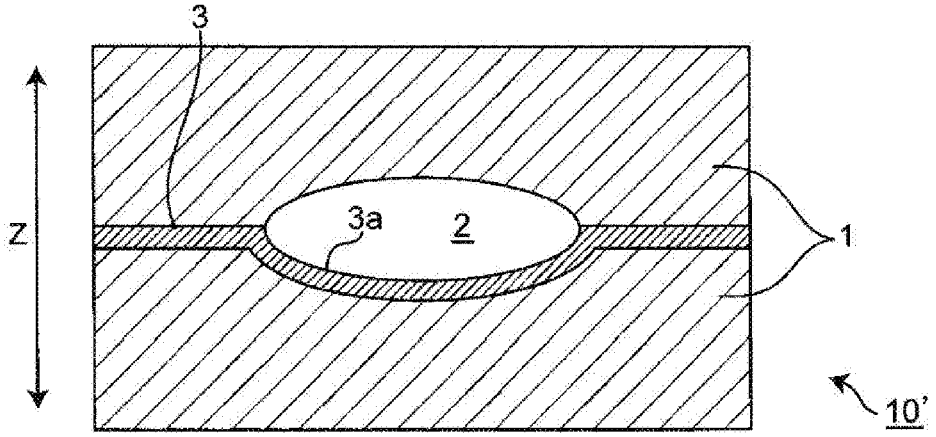

The multilayer body obtained as described above is fired so as to obtain a sintered body 10' in which the fuse conductor 3 derived from the conductor paste 3' and the main body portion 1 derived from the insulating material green sheet 1' are co-sintered (FIG. 9E). The firing temperature and the firing time have to be the temperature and the time that are sufficient for sintering the insulating material used for the insulating material green sheet 1' and the conductor powder used for the conductor paste 3'.

During the firing, the disappearing material 4 evaporates gradually (for example, burns and evaporates due to thermal decomposition), generated gases push, due to volume expansion, the surrounding insulating material and conductor that are in the midstream of firing so as to expand the space gradually, and, as a result, the entire disappearing material 4 evaporates so as to "disappear", the hollow portion 2 is formed, and the portion of the fuse conductor 3 (including the fusing portion 3*a*) exposed to the hollow portion 2 is formed along the wall surface of the hollow portion 2 (refer to FIG. 9E).

In particular, during the firing process, since the gases may isotropically push, due to volume expansion, the surrounding insulating material and conductor that are in the midstream of firing, and, therefore, regarding the formed hollow portion, two wall surfaces that are opposite each other are curved outward in opposite directions and may have preferably an elliptical cross section, and the fusing portion 3*a* is formed along one wall surface so as to be curved outward (downward in the aspect shown in the drawing) and preferably may be formed into an arch-like shape. The inner wall surface of the main body portion 1 exposed to the thus formed hollow portion 2 (and the upper surface and the side surface of the fuse conductor 3 exposed to the hollow portion 2) may become smooth.

As the situation demands, the sintered body 10' obtained as described above may be subjected to barrel polishing to round corners, and, in addition, both end portions of the fuse conductor 3 may be sufficiently exposed at the main body portion 1.

Thereafter, the outer electrodes 9*a* and 9*b* are formed so as to cover respective end portions of the sintered body 10' and to be connected to the respective end portions of the fuse conductor 3. In this manner, the chip-type fuse 10 (refer to FIG. 1 to FIG. 3) is produced.

According to the present embodiment, since the conductor paste 3' is directly applied on the smooth surface of the insulating material green sheet 1' (FIG. 9B), even a fine pattern can be printed with high resolution (substantially without occurrences of printing bleeding and printing variations). The thickness and the shape of the fusing portion 3*a* can be readily changed by changing the printing pattern and/or the printing condition of the conductor paste 3'. Therefore, various fusing characteristics can be obtained.

According to the present embodiment, a screen printing and sheet stacking method that has achievements in mass production of chip-type multilayer ceramic capacitors (MLCCs) and the like and that enables mass production to be performed at low cost can be exploited. Since screen printing is performed only two times, that is, application of the conductor paste 3' and application of the disappearing material 4, the production cost can be reduced to a low level. The method for producing the chip-type fuse according to the present embodiment does not require expensive devices for lasing, photolithography, sputtering, and the like to form the fusing portion 3*a* by processing.

In the present embodiment, when a current passes through the fuse conductor 3, heat generation of the fusing portion 3*a* can be facilitated by suppressing heat dissipation from the fusing portion 3*a* of the fuse conductor 3 to the main body portion 1 by a heat insulation effect of the hollow portion 2. Therefore, there is no need of other measures to facilitate heat generation, for example, oxidation of the conductor to increase the direct-current resistance of the fusing portion 3*a* and coverage of the fusing portion 3*a* with a resin layer.

An exemplary chip-type fuse 11 according to the present embodiment described above with reference to FIGS. 7 and 8 can be produced as described below with reference to FIGS. 10A to 10E. In this regard, the same description as above applies unless otherwise specified.

Figure 10A:
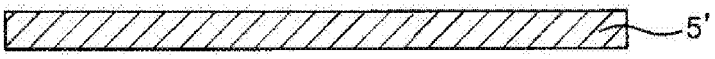
FIGS. 10A to 10E are diagrams illustrating a method for manufacturing the exemplary chip-type fuse according to the present disclosure shown in FIG. 7.
Figure 10B:
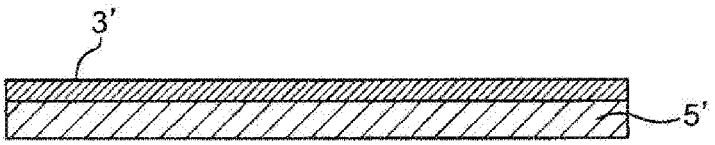
Figure 10C:
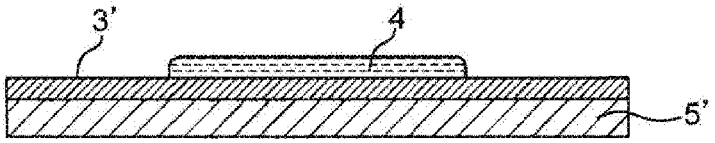
Figure 10D:
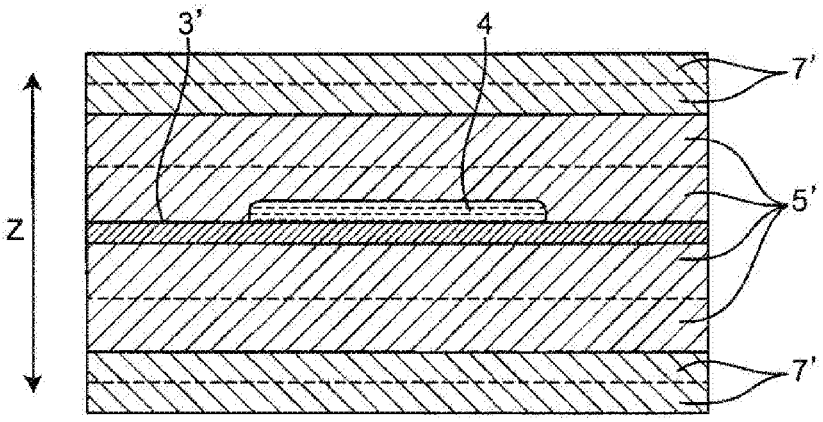
Figure 10E:
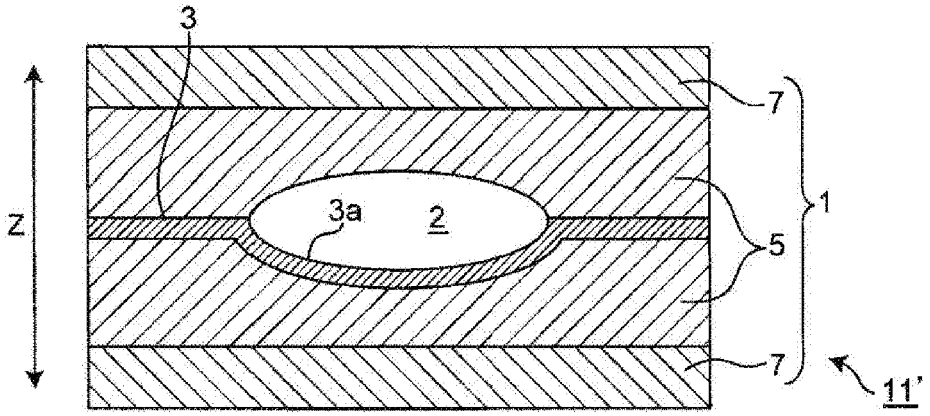

A green sheet 5' of the above-described first insulating material is prepared (FIG. 10A). The conductor paste 3' having a predetermined pattern is applied to a smooth surface of the resulting green sheet 5' (FIG. 10B). Subsequently, the disappearing material 4 is applied to the first insulating material green sheet 5' to which the conductor paste 3' is applied (FIG. 10C). A multilayer body is obtained by stacking a predetermined number of new first insulating material green sheets 5' on the top and the bottom of the insulating material green sheet 5' to which the conductor paste 3' and the disappearing material 4 are applied, obtained as described above, and stacking a predetermined number of second insulating material green sheets 7' outside the first insulating material green sheets 5' (on both the top and the bottom in the aspect shown in the drawing, but may be on one of the top and the bottom) so as to ensure respective predetermined thicknesses (in the drawing, the stacking direction is indicated by Z), performing pressure bonding, and performing cutting into predetermined dimensions (FIG. 10D). The multilayer body obtained as described above is fired so as to obtain a sintered body 11' in which the fuse conductor 3 derived from the conductor paste 3' and the main body portion 1 composed of a layer 5 formed of the first insulating material derived from the first insulating material green sheet 5' and a layer 7 formed of the first insulating material derived from the second insulating material green sheet 7' are co-sintered (FIG. 10E). Thereafter, the outer electrodes 9*a* and 9*b* are formed so as to cover respective end portions of the sintered body 11' and to be connected to the respective end portions of the fuse conductor 3. In this manner, the chip-type fuse 11 (refer to FIGS. 7 and 8) is produced.

Next, an aspect of using the chip-type fuse 10 (the chip-type fuse 11 shown in FIGS. 7 and 8 may be included unless otherwise specified) according to the present embodiment will be described.

The chip-type fuse 10 according to the present embodiment may be incorporated into an electric-electronic circuit by using any appropriate method. In particular, the chip-type fuse 10 is arranged such that the outer electrodes 9*a* and 9*b* are located on a pair of pads (or lands) disposed on the surface of a mount body, for example, a circuit board, and is incorporated into the electric circuit by bonding the outer electrodes to the respective pads with a solder material, and a mounted structure in which the chip-type fuse 10 is thereby mounted on the mount body is obtained.

When a current passes through the chip-type fuse 10 incorporated into the electric circuit, heat is generated due to Joule's heat. For example, if a flowing current excessively increases (exceeds a rated current), fusing occurs at the fusing portion 3*a* in accordance with the fusing characteristics, and the function as a fuse is performed. At this time, the conductor constituting the fusing portion 3*a* tends to heat-shrink immediately after fusing because of the presence of the hollow portion 2, and a large distance between the conductors after fusing can be ensured. As a result, even when an excessive voltage is applied after fusing, insulation performance can be maintained without an occurrence of short circuit, and high withstand voltage (breakdown voltage) can be exhibited. In addition, the insulating material of the main body portion 1 (preferably, first insulating material) may be softened due to heat generation, and thereby, fused conductor substance can be trapped by the insulating material of the main body portion 1, and the conductor substance can be suppressed from scattering.

The chip-type fuse 10 according to the present embodiment has excellent fusing characteristics and can be reduced in size, and a chip-type fuse having, for example, a length L of 0.55 mm or more and 0.65 mm or less (i.e., from 0.55 mm to 0.65 mm) and a width W of 0.25 mm or more and 0.35 mm or less (i.e., from 0.25 mm to 0.35 mm), such as a chip-type fuse with a 0603 size (0.6 mm×0.3 mm), can be realized.

The stacking direction Z of the chip-type fuse 10 may be in accord with either the direction of the width W or the direction of the height T of the chip-type fuse 10. However, it is preferable that the stacking direction Z be perpendicular to the bending direction of the mount body rather than parallel because the mechanical strength (bending strength)

during mounting is enhanced. In the case in which the mount body is a circuit board, the bending direction of the mount body may be the direction perpendicular to the surface of the mount body. Therefore, it is preferable that the stacking direction Z be parallel to the surface of the mount body rather than perpendicular because the mechanical strength (bending strength) is enhanced.

Figure 11:
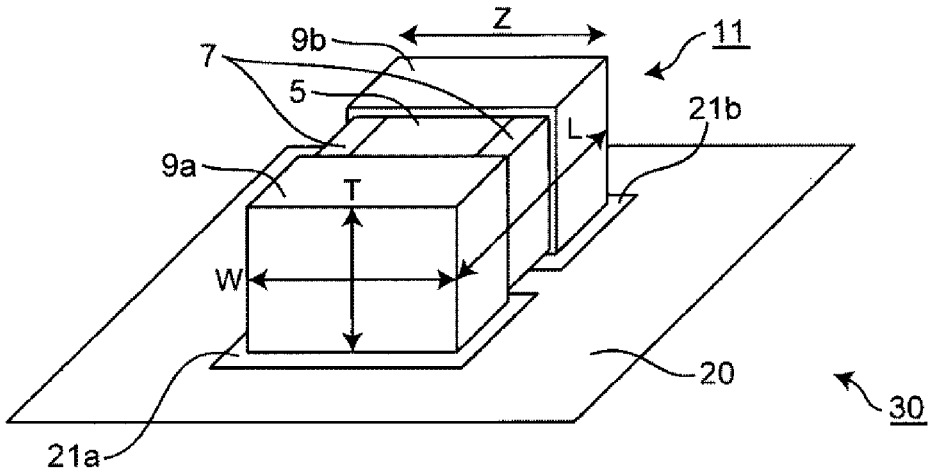
FIG. 11 is a diagram illustrating an aspect of using the exemplary chip-type fuse according to the present disclosure shown in FIG. 7.
Figure 12:
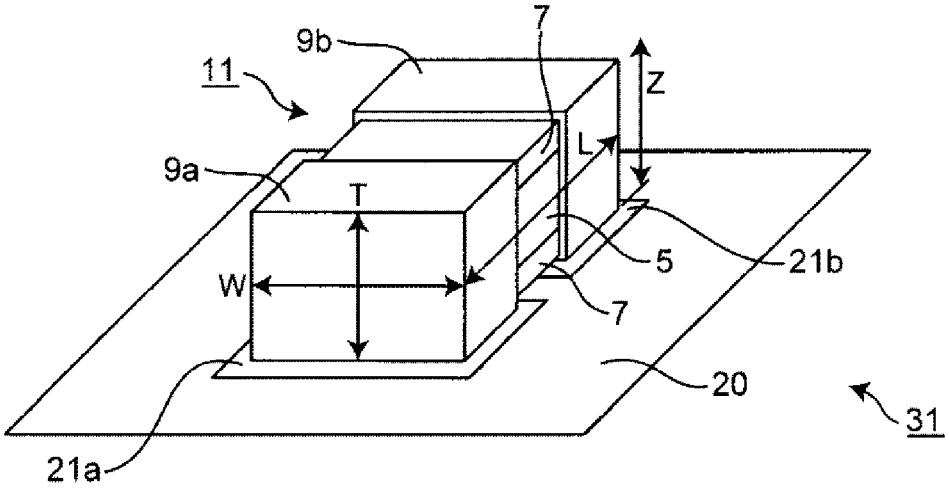
FIG. 12 is a diagram illustrating another aspect of using the exemplary chip-type fuse according to the present disclosure shown in FIG. 7.

The above-described effect of enhancing the mechanical strength in accordance with selection of the relationship between the stacking direction Z and the mounting direction is considerable regarding an exemplary chip-type fuse 11 in the present embodiment described above with reference to FIGS. 7 and 8. As shown in FIG. 11, the chip-type fuse 11 may be arranged such that the stacking direction Z is substantially parallel to the mount body surface 20, and the outer electrodes 9*a* and 9*b* may be bonded to the pads 21*a* and 21*b* with a solder material (not shown in the drawing) so as to constitute a mounted structure 30. Alternatively, the chip-type fuse 11 may be arranged such that the stacking direction Z is substantially perpendicular to the mount body surface 20, and bonding may be performed in the same manner as above so as to constitute the mounted structure 30. In the case in which the mount body is a circuit board, it is preferable that the stacking direction Z be parallel (refer to FIG. 11) to the mount body surface 20 rather than perpendicular (refer to FIG. 12) because the mechanical strength (bending strength) is enhanced.

EXAMPLES

1. Production of Chip-Type Fuse

A chip-type fuse was produced as described below.

(1-1) Production of Glass Material Green Sheet

A glass powder was produced by weighing and mixing $K_2O$, $B_2O_3$, and $SiO_2$ such that $K_2O$ was 2% by weight, $B_2O_3$ was 20% by weight, and $SiO_2$ was 78% by weight, placing these into a platinum crucible, performing melting at a temperature of 1500° C. to 1,600° C., and performing rapid cooling and pulverization. After 5% by weight alumina and 30% by weight of quartz serving as fillers were mixed to 65% by weight of glass powder, a solvent, a binder, and a plasticizer were added to the resulting mixture, and mixing was performed sufficiently, a glass material green sheet was produced by using a doctor blade method or the like.

(1-2) Production of Non-Magnetic Ferrite Material Green Sheet

A non-magnetic ferrite powder was produced by weighing 48.5% by mole of $Fe_2O_3$, 43.5% by mole of ZnO, and 8.0% by mole of CuO, performing wet mixing-pulverization and drying, calcining the resulting dried material at a temperature of 700° C. to 800° C., and performing pulverization. After a solvent, a binder, and a plasticizer were added to the resulting non-magnetic ferrite powder, mixing was performed sufficiently, and a non-magnetic ferrite material green sheet was produced by using a doctor blade method or the like.

(1-3) Production of Chip-Type Fuse

Figure 13A:
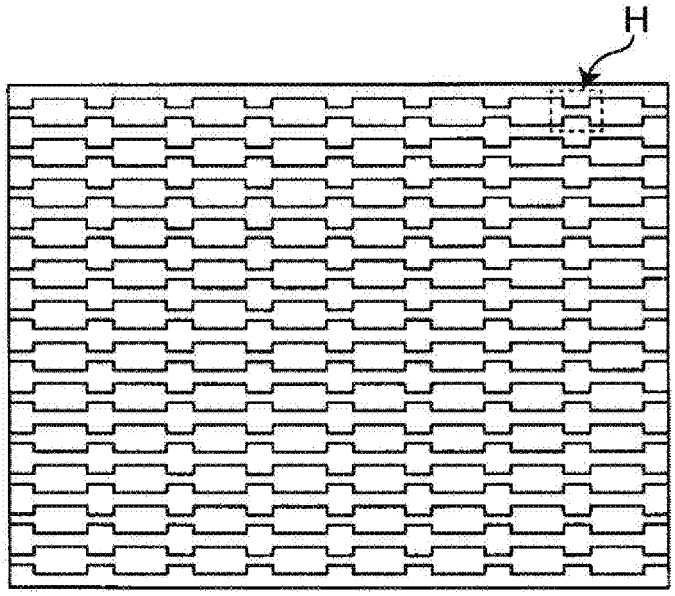
FIGS. 13A to 13D are schematic diagrams showing a silver paste pattern printed for forming a fuse conductor in an example according to the present disclosure, such that FIG. 13A is a top view of an entire image of an exemplary silver paste pattern printed.
Figure 13B:
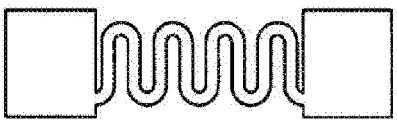
Figure 13C:
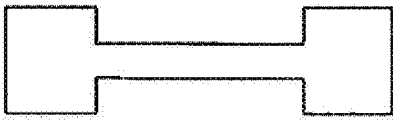
Figure 13D:
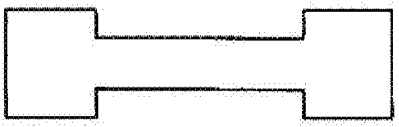

Each of the thus produced glass material green sheet and non-magnetic ferrite material green sheet was stamped into a rectangular shape (dimensions suitable for multiple-piece production). A silver paste pattern suitable for, for example, multiple-piece production, as schematically shown in FIG. 13A, was formed by applying a silver paste with the pattern to the glass material green sheet by screen printing. This silver paste pattern was a pattern to form a fuse conductor, and the portion corresponding to a fusing portion in the pattern was made into a meandering shape (FIG. 13B, example 1) or a rectilinear shape (FIG. 13C, example 2 or FIG. 13D, example 3) (in this regard, FIG. 13A shows an exemplary case in which the fusing portion is made into a rectilinear shape, and the number of pieces is exemplarily shown in FIG. 13A but is not limited to this). The dimensions (after firing) of the fusing portion of each pattern was as described below.

TABLE 1

| | Example 1 meandering shape | Example 2 rectilinear shape | Example 3 rectilinear shape |
|---|---|---|---|
| Track width | 15 μm | 30 μm | 40 μm |
| Thickness | 5 μm | 5 μm | 5 μm |

Next, a disappearing material with a pattern suitable for multiple-piece production was applied to the silver paste pattern by screen printing. An acrylic resin paste was used as the disappearing material.

A block was produced by interposing the glass material green sheet, on which the silver paste pattern and the disappearing material pattern were applied, between a predetermined number of new glass material green sheets (no pattern was printed) obtained as described above, interposing the resulting multilayer body between a predetermined number of non-magnetic ferrite material green sheets, and performing pressure bonding. The resulting block was cut with a dicing machine or the like into individual pieces. The individualized element was placed into a firing furnace and fired at about 900° C. for 2 hours. The resulting sintered body was subjected to barrel polishing so as to round corners.

Thereafter, both end portions of the sintered body were coated with a silver paste, and baking was performed at a temperature of about 800° C. so as to form underlying electrodes. Subsequently, a Ni coating and a Sn coating were formed successively on each underlying electrode by electroplating so as to form outer electrodes.

In this manner, samples of the chip-type fuses (examples 1 to 3) were produced. Regarding the sizes of the resulting sample of each of examples 1 to 3, the length L was 0.6 mm, the width W was 0.3 mm, and the height T was 0.3 mm.

The height dimension of the hollow portion was determined as described below. The produced sample was vertically stood, and the sample was surrounded by a solidified resin. At this time, the LT side surface was exposed. Polishing was performed in the W-direction of the sample by using a polishing machine, and polishing was finished at the depth in the substantially central portion of the hollow. The hollow portion was imaged by SEM, the dimension at the highest position of the hollow portion in a photograph was measured, and an average of the measured values of three samples were taken as the height dimension of the hollow portion. The measurement result of each of examples 1 to 3 was about 30 μm.

In addition, the thickness of each of the central glass layer and upper and lower non-magnetic ferrite layers was measured. As a result, the thickness of the glass layer was 100

μm, and the thickness of each of the upper and lower non-magnetic ferrite layers was 100 μm.

2. Evaluation of Chip-Type Fuse

Figure 14:
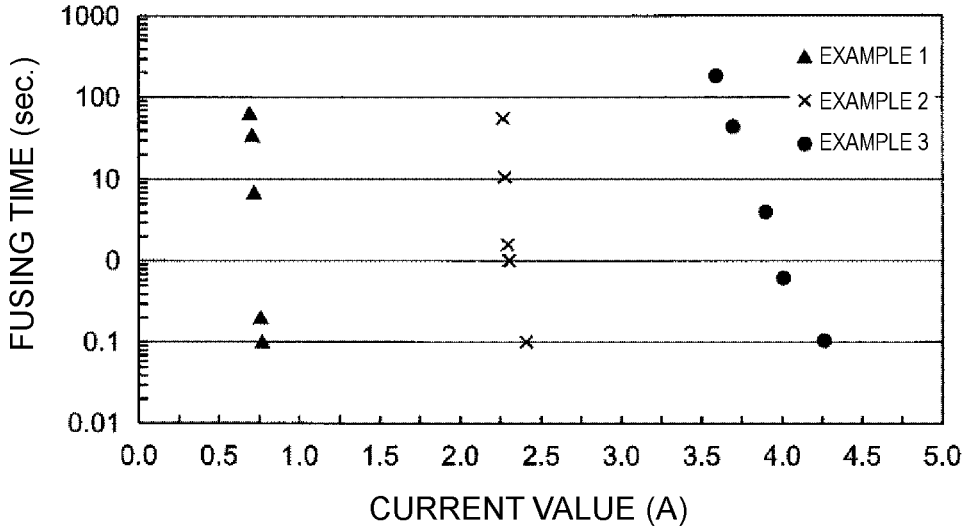
FIG. 14 is a graph showing the evaluation results of samples of the chip-type fuses produced in examples 1 to 3 of the present disclosure.

The fusing characteristics of the resulting samples of examples 1 to 3 were evaluated. Regarding the fusing characteristics, a predetermined value of current was passed between the outer electrodes from a direct current power supply, the current was observed by using an oscilloscope, and the time (fusing time) from start of passing the current until stop of passing the current due to fusing was determined. The current value was changed, and the fusing time with respect to each of the current value was determined. The results are shown in FIG. 14. As is clear from FIG. 14, the current value at which fusing occurred was changed by changing the thickness and the cross-sectional area (track width and thickness) of the fusing portion of the fuse conductor. Consequently, it is understood that the current value at which fusing occurs can be designed by selecting the cross-sectional area (track width and thickness) of the fusing portion of the fuse conductor.

Next, regarding the fused sample, a direct current voltage was applied between the pair of outer electrodes, and the direct current breakdown voltage was measured. Ten samples of each of examples 1 to 3 (30 samples in total) were measured. As a result, the breakdown voltage exhibited by every sample was 1,000 V or more.

The chip-type fuse according to the present disclosure is incorporated into circuits of electric-electronic apparatuses and can be widely used in various fields for the purpose of, for example, protecting electric-electronic apparatuses and the like from, for instance, overvoltage, overcurrent, and/or overheating.

What is claimed is:

1. A chip-type fuse comprising:

a main body portion including an insulating material, the main body portion having at least one wall surface defining at least part of a hollow portion inside the main body portion;

a fuse conductor that is disposed inside the main body portion and that has both end portions exposed from the main body portion, the fuse conductor having a curved fusing portion disposed in direct contact with a corresponding curve of the wall surface; and a pair of outer electrodes that cover respective end portions of the main body portion, and each of the outer electrodes is electrically connected to a respective one of the end portions of the fuse conductor, wherein the hollow portion has an approximately elliptical cross-section.

2. A chip-type fuse comprising:

a main body portion including an insulating material, the main body portion having at least one wall surface defining at least part of a hollow portion inside the main body portion;

a fuse conductor that is disposed inside the main body portion and that has both end portions exposed from the main body portion, the fuse conductor having a fusing portion disposed along the wall surface; and a pair of outer electrodes that cover respective end portions of the main body portion, and each of the outer electrodes is electrically connected to a respective one of the end portions of the fuse conductor, wherein the main body portion has two wall surfaces that are curved outward in opposite directions and that are opposite each other to define the at least part of the hollow portion, and the fusing portion of the fuse conductor is disposed along any one of the two wall surfaces.

3. The chip-type fuse according to claim 1, wherein the main body portion and the fuse conductor constitute a sintered body.

4. The chip-type fuse according to claim 1, wherein the fusing portion has a meandering shape.

5. The chip-type fuse according to claim 1, wherein a portion in contact with at least the fusing portion in the main body portion is composed of a first insulating material having a thermal conductivity of from 0.05 $W \cdot m^{-1} \cdot K^{-1}$ to 10.00 $W \cdot m^{-1} \cdot K^{-1}$.

6. A chip-type fuse comprising:

a main body portion including an insulating material, the main body portion having at least one wall surface defining at least part of a hollow portion inside the main body portion;

a fuse conductor that is disposed inside the main body portion and that has both end portions exposed from the main body portion, the fuse conductor having a fusing portion disposed along the wall surface; and a pair of outer electrodes that cover respective end portions of the main body portion, and each of the outer electrodes is electrically connected to a respective one of the end portions of the fuse conductor, wherein a portion in contact with at least the fusing portion in the main body portion is composed of a first insulating material having a thermal conductivity of from 0.05 $W \cdot m^{-1} \cdot K^{-1}$ to 10.00 $W \cdot m^{-1} \cdot K^{-1}$, and the main body portion includes a layer that is composed of the first insulating material having a thermal conductivity of from 0.05 $W \cdot m^{-1} \cdot K^{-1}$ to 10.00 $W \cdot m^{-1} \cdot K^{-1}$, and that has the fuse conductor and the hollow portion inside and includes at least one layer composed of a second insulating material having higher strength than the first insulating material.

7. The chip-type fuse according to claim 6, wherein the layer composed of the first insulating material is disposed between two layers composed of the second insulating material.

8. The chip-type fuse according to claim 1, wherein the insulating material is a non-magnetic material.

9. The chip-type fuse according to claim 1, wherein the chip-type fuse has a length of from 0.55 mm to 0.65 mm, and a width of from 0.25 mm to 0.35 mm.

10. The chip-type fuse according to claim 2, wherein the main body portion and the fuse conductor constitute a sintered body.

11. The chip-type fuse according to claim 2, wherein the fusing portion has a meandering shape.

12. The chip-type fuse according to claim 3, wherein the fusing portion has a meandering shape.

13. The chip-type fuse according to claim 2, wherein a portion in contact with at least the fusing portion in the main body portion is composed of a first insulating material having a thermal conductivity of from 0.05 $W \cdot m^{-1} \cdot K^{-1}$ to 10.00 $W \cdot m^{-1} \cdot K^{-1}$.

14. The chip-type fuse according to claim 3, wherein a portion in contact with at least the fusing portion in the main body portion is composed of a first insulating material having a thermal conductivity of from 0.05 $W \cdot m^{-1} \cdot K^{-1}$ to 10.00 $W \cdot m^{-1} \cdot K^{-1}$.

15. The chip-type fuse according to claim 4, wherein a portion in contact with at least the fusing portion in the main body portion is composed of a first insulating material having a thermal conductivity of from 0.05 $W \cdot m^{-1} \cdot K^{-1}$ to 10.00 $W \cdot m^{-1} \cdot K^{-1}$.

16. The chip-type fuse according to claim 2, wherein the insulating material is a non-magnetic material.

17. The chip-type fuse according to claim 3, wherein the insulating material is a non-magnetic material.

18. The chip-type fuse according to claim 4, wherein the insulating material is a non-magnetic material.

19. The chip-type fuse according to claim 2, wherein the chip-type fuse has a length of from 0.55 mm to 0.65 mm, and
a width of from 0.25 mm to 0.35 mm.

20. The chip-type fuse according to claim 3, wherein the chip-type fuse has a length of from 0.55 mm to 0.65 mm, and
a width of from 0.25 mm to 0.35 mm.

* * * * *